US007208078B2

(12) United States Patent
Weissman et al.

(10) Patent No.: US 7,208,078 B2
(45) Date of Patent: Apr. 24, 2007

(54) DIESEL FUEL FORMULATION FOR REDUCED EMISSIONS

(75) Inventors: Walter Weissman, Basking Ridge, NJ (US); John T. Farrell, High Bridge, NJ (US); Shizuo Sasaki, San Antonio, TX (US); Kazuhiro Akihama, Owariasahi (JP); Kiyomi Nakakita, Fujioka-cho (JP)

(73) Assignee: ExxonMobil Research and Engineering Company, Annandale, NJ (US)

( * ) Notice: Subject to any disclaimer, the term of this patent is extended or adjusted under 35 U.S.C. 154(b) by 266 days.

(21) Appl. No.: 10/393,167

(22) Filed: Mar. 20, 2003

(65) Prior Publication Data

US 2003/0233785 A1 Dec. 25, 2003

Related U.S. Application Data

(60) Provisional application No. 60/366,943, filed on Mar. 22, 2002.

(51) Int. Cl.
*C10L 1/08* (2006.01)

(52) U.S. Cl. ..... 208/15; 44/300; 585/14

(58) Field of Classification Search ..... 208/15; 44/300; 585/14

See application file for complete search history.

(56) References Cited

U.S. PATENT DOCUMENTS 5,210,347 A * 5/1993 Chen et al. ..... 585/14
5,389,111 A 2/1995 Nikanjam et al. ..... 44/300
5,389,112 A * 2/1995 Nikanjam et al. ..... 44/300
5,792,339 A * 8/1998 Russell ..... 208/15
5,976,201 A 11/1999 Barrey et al. ..... 44/413
6,004,361 A * 12/1999 Barry et al. ..... 44/413
6,096,103 A * 8/2000 Hubbard et al. ..... 44/300
6,150,575 A 11/2000 Angevine et al. ..... 585/14
6,296,757 B1 * 10/2001 Wittenbrink et al. ..... 208/15
6,461,497 B1 * 10/2002 Pedersen ..... 208/15

(Continued)

FOREIGN PATENT DOCUMENTS

WO WO92/14804 9/1992

(Continued)

OTHER PUBLICATIONS

Aaron Oakley, et al., Feasibility Study of an Online Gasoline Fractionating System for use in Spark-Ignition Engines, SAE 2001 World Congress, Detroit, Michigan, Mar. 5-8, 2001.

(Continued)

*Primary Examiner*—Ellen M. McAvoy
(74) *Attorney, Agent, or Firm*—Paul E. Purwin

(57) ABSTRACT

The invention is directed to a method and formula for producing a fuel having reduced particulate emissions from an internal combustion engine. The fuel taught herein is characterized as having a cetane number ranging from about 45 to about 65, a $T_{95}$ distillation property of less than about 370° C., and having NR, AR, cetane number and $T_{95}$ defined by the relation:

$$PEI=156+Z_1\times(\text{cetane\#}-49)+Z_2\times(NR-14)+Z_3\times(AR-25)+Z_4\times(T_{95}-315^\circ\text{ C.})$$

Where $Z_1$ ranges from abut 0.67 to about 1.06,
$Z_2$ ranges from about 0.9 to about 1.28,
$Z_3$ ranges from about 2.54 to about 2.80,
$Z_4$ ranges from about 0.1 to about 0.4,
NR is a defined correlation of the naphthene rings content in the fuel, and
AR is a defined correlation of the aromatic rings content in the fuel.

44 Claims, 3 Drawing Sheets

U.S. PATENT DOCUMENTS

| | | | | |
|---|---|---|---|---|
| 6,893,475 | B1 * | 5/2005 | Ellis et al. | 44/300 |
| 2001/0001803 | A1 | 5/2001 | Hubbard et al. | 585/14 |

FOREIGN PATENT DOCUMENTS

| | | |
|---|---|---|
| WO | WO95/23836 | 9/1995 |
| WO | WO01/32809 | 5/2001 |

OTHER PUBLICATIONS

Kiyomi Nakakita et al., Effect of Hydrocarbon Molecular Structure on Diesel Exhaust Emissions, Part 1: Comparison of Combustion and Exhaust Emission Characteristics Among Representative Diesel Fuels, SAE Technical Paper Series #982494, International Fall Fuels and Lubricants Meeting and Exposition, San Francisco, CA, Oct. 19-22, 1998.

* cited by examiner

DIESEL FUEL FORMULATION FOR REDUCED EMISSIONS

This application claims the benefit of U.S. Provisional Application(s) No(s).: Application No(s).: 60/366,943 filed on Mar. 22, 2002

FIELD OF THE INVENTION

The invention is related to fuels for reducing emissions from internal combustion engines ("IC engines") and more particularly a fuel and fuel formulation process to reduce particulate emissions from diesel engines.

BACKGROUND

Increasingly stringent environmental restrictions on air emissions from IC engines have prompted development of technologies to reduce engine emissions, particularly $NO_x$ and particulate emissions. Particulate matter emissions ("PM emissions"), which are typically carbonaceous materials (sometimes referred to as soot), have been conventionally reduced by "hardware strategies" such as fuel injection modifications and the like. More recent technology advances recognize the need for fuel advancement along with advancements in hardware.

A number of studies have been performed that attempt to correlate the fuel's molecular properties to its tendency to create PM emissions. General trends have been established for specific fuel properties that contribute to increased pollutant formation in diesel engines. These include the percentages of sulfur, nitrogen, aromatics, and polynuclear aromatic hydrocarbons, as well as either the density or the carbon/hydrogen (C/H) ratio of the fuel. For example, Miyamoto et al. (SAE 940676) investigated a paraffinic base fuel with varying levels of mono-aromatic and polyaromatic components. Beatrice et al. (SAE 961972) report the results of a twelve fuel matrix in which a wide range of fuels, including Fischer Tropsch and oxygenated materials, were evaluated. Ogawa et al. (SAE 952351) put forth a simplified model for PM formation which depends on the C/H ratio of the fraction of the fuel that boils above 310° C., i.e., the high molecular weight fraction constituting ~20% of the fuel. The European Auto/Oil Consortium has studied a broad range of fuels in a wide range of vehicles (SAE 961073, 961074 and 961075). PM formation of the fuels was correlated with density, % PNA, T95, % total aromatics, and cetane number (CN) of the fuel. Nakakita and coworkers (SAE 982494, 982495), however, presented contrasting results from engine tests in which an aromatic-containing fuel generated less PM than a fuel with lower density, distillation temperature, aromatic content, and sulfur. Other fuel properties have been identified as having a positive effect on emissions reduction. These properties include oxygenates concentration, paraffin concentration (especially n-paraffin level), and cetane number. Recent studies teach or infer that a Fischer-Tropsch type of fuel (i.e., one very high in n-paraffin content and thus high CN) is an ideal low emissions diesel fuel (SAE 2001-01-3518, 2000-01-1803). U.S. Pat. No. 5,807,413, for example, teaches the use of a "synthetic" fuel derived from a Fisher-Tropsch process that exhibits reduced emissions.

On the hardware side, there have been significant advances in the development of cleaner engines and advanced aftertreatment technologies. Sophisticated modeling and experimental engine diagnostic capabilities have permitted the design of more highly optimized cylinder geometries, fuel delivery and injection approaches, and computer-controlled optimization of engine operating variables. There have been corresponding advances in the area of aftertreatment, in particular with regard to the development and commercialization of NOx storage and release catalysts and diesel particulate filters for PM removal.

To date, however, there have been few combined fuel/hardware strategies employed to enable reduced pollutant production in diesel engines. Often recourse to costly "synthetic fuels" that are perceived to generate lower emissions is advocated as a means to achieve lower emissions. The present invention has the advantage of allowing lower PM emissions operation with more effective $deNO_x$ aftertreatment, with fuel formulation and fueling approaches that have the potential to be widely available and cost effective. These benefits are achieved through the use of the invention described herein to facilitate the formulation of a low PM emission fuel that may be used with a variety of aftertreatment systems. In one embodiment, the fuel of this invention is utilized during specific portions of the driving cycle and conventional fuels during other portions of the driving cycle.

SUMMARY OF THE INVENTION

In one embodiment, the invention is a fuel for a compression ignition engine that results in substantially reduced particulate emissions. A particulate emissions index ("PEI") is identified and defined for a conventional, low emission fuel against which the particulate emissions produced by use of the fuel of this invention is defined. The fuel taught herein is characterized as having a cetane number ranging from about 45 to about 65, a $T_{95}$ distillation property of less than about 370° C., and having NR, AR, cetane number and $T_{95}$ defined by the relation:

$$PEI=156+Z_1\times(\text{cetane\#}-49)+Z_2\times(NR-14)+Z_3\times(AR-25)+Z_4\times(T_{95}-315^\circ\text{ C.})$$

Where $Z_1$ ranges from abut 0.67 to about 1.06, $Z_2$ ranges from about 0.9 to about 1.28, $Z_3$ ranges from about 2.54 to about 2.80, $Z_4$ ranges from about 0.1 to about 0.4, NR is a defined correlation of the naphthene rings content in the fuel, and AR is a defined correlation of the aromatic rings content in the fuel.

In a preferred embodiment, PEI is less than about 100, i.e., the PEI value for a typical Fischer-Tropsch type diesel fuel. In another embodiment, the Formula may be used to adjust the fuel constituents, selectively, to improve the PM emissions characteristics of a given fuel. In a further embodiment, the invention teaches the use of the low PM fuel during key segments of the drive cycle to improve the PM emissions performance of the IC engine during otherwise high emission portions of the drive cycle.

The improved PM fuel may be beneficially used alone, or blended with one or more conventional diesel fuel(s) or used during specific portions of the drive cycle in conjunction with conventional diesel fuels during the remaining portions of the drive cycle. The fuel may be used with, or without, aftertreatment systems.

DETAILED DESCRIPTION OF THE INVENTION

Figure 1:
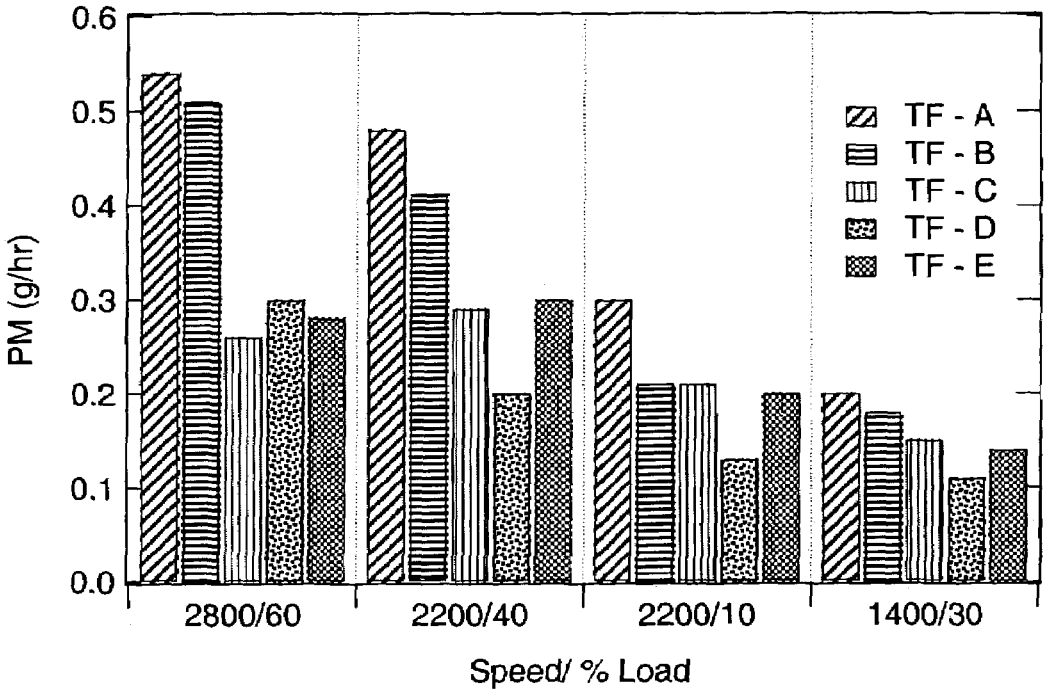
FIG. 1 is a graph depicting PM emissions results from tests of fuels of varying PEI.

This invention is based on the discovery of the effects of fuel molecular structure on exhaust emissions and combustion characteristics in IC engines. More specifically, the inventors have discovered unique fuel formulations to reduce particulate matter emissions from compression ignition engines. In a preferred embodiment, the compression ignition engine comprises a light duty diesel engine. The term light duty, as used herein to describe diesel engines, are engines used for passenger cars, sport-utility vehicles (SUV), light-duty trucks and buses, and similar such. The light-duty trucks and buses mentioned above are defined as the trucks and buses with gross vehicle weight (GVW) of less than or equal to about 2.5 tons in Japan, and less than or equal to about 8,500 pounds in the U.S., and classified into categories M1 (number of passengers of less than or equal to 9) and N1 (GVW of less than or equal to 3.5 ton. in Europe). Heavy duty diesel engines, as used herein, are those diesel engines used to power stationary sources and vehicles other than those types stated above.

The fuel may be used during routine driving or advantageously during drive cycle periods known as problematic for PM emissions such as high torque/high load, high engine speed (RPM) conditions, rapid acceleration, high altitude operation (i.e., greater than about 800 meters), and similar such. The fuel may be used in conventionally configured diesel engines, and advantageously in conjunction with exhaust aftertreatment systems such as oxidation catalysts, $NO_x$ Storage Reduction ("NSR") systems, Diesel Particulate Filters ("DPF") systems, Diesel Particulate-NOx-Reduction Systems (DPNR), continuously regenerating traps (CRT), diesel particulate filter (DPF) with or without soot oxidation additives, selective catalytic reduction (SCR) with or without urea, 3-way catalysts, and the like, all of which are known in the art. A fuel Formula provides the user of this invention the means to formulate low PM emissions fuels.

The low PM emission fuel of the present invention is formulated in accordance with the formula ("Formula"):

$$PEI=156+Z_1\times(\text{Cetane\#}-49)+Z_2\times(NR-14)+Z_3\times(AR-25)+Z_4\times(T_{95}{}^{\circ}\text{ C.}-315)$$

Where $Z_1$ ranges from abut 0.67 to about 1.06, $Z_2$ ranges from about 0.9 to about 1.28, $Z_3$ ranges from about 2.54 to about 2.80, $Z_4$ ranges from about 0.1 to about 0.4, NR is a defined correlation of the naphthene rings content in the fuel, and AR is a defined correlation of the aromatic rings content in the fuel.

PEI is particulate emissions index. PEI is a composite of cetane number, $T_{95}$, AR and NR as defined by the Formula.

Referring back to the Formula, the value of $Z_1$ ranges from about 0.67 to about 1.06, preferably from about 0.77 to about 0.97, and most preferably is about 0.87. $Z_2$ ranges from about 0.9 to about 1.28, preferably from abut 1.0 to about 1.8, and is most preferably about 1.09. $Z_3$ ranges from about 2.54 to about 2.80, preferably from about 2.61 to about 2.74, and is most preferably about 2.67. $Z_4$ ranges from about 0.1 to about 0.4, and is preferably about 0.2

The successful use of the Formula depends on an accurate and detailed characterization of the molecular composition of the fuel into the following classes: (a) % normal plus iso-paraffin, (b) % 1-ring cycloparaffin, (c) % 2-ring cycloparaffin, (d) % 3-ring+cycloparaffin, (e) % 1-ring aromatics, (f) % 2-ring aromatics, (g) % 3-ring+aromatics, (h) % naphtho-aromatics, by techniques such as gas chromatography coupled with mass spectrometry. For the above classes, the term "naphthene" and "cycloparaffin" are synonymous and 3-ring+means three or more rings. In a preferred embodiment, gentle ionization techniques are utilized so as to minimize error in the interpretation of the mass spectrometric data introduced from parent mass fragmentation.

The values of AR and NR are defined, and are determined by summing the terms as prescribed in the table below:

TABLE 1

| No. of Aromatic Rings | No. of Naphthene Rings | AR | NR |
|---|---|---|---|
| 1 | 0 | 6/14 × wt % | 0 |
| 2 | 0 | 12/14 × wt % | 0 |
| 3, 3+ | 0 | 1 × wt % | |
| 0 | 1 | 0 | 6/14 × wt % |
| 0 | 2 | 0 | 12/14 × wt % |
| 0 | 3, 3+ | 0 | 1 × wt % |
| 1 | 1 | 6/14 × wt % | 6/14 × wt % |
| 2 | 1 | 2/3 × wt % | 1/3 × wt % |
| 1 | 2 | 1/3 × wt % | 2/3 × wt % |
| 3, 3+ | 1 | 3/4 × wt % | 1/4 × wt % |
| 1 | 3, 3+ | 1/4 × wt % | 3/4 × wt % |
| 2 | 2 | 1/2 × wt % | 1/2 × wt % |

For example, if a fuel contains 77% normal plus iso-isoparaffins, 14% one-ring aromatics, and 9% of the class of molecules having one aromatic ring and two naphthene rings, the AR value is 6+3=9 and the NR value is 0+6=6.

The Formula may be used to reduce PM emissions from conventional, sulfur containing fuels. However, in one embodiment fuel sulfur is limited to less than about 120 ppm, preferably less than about 30 ppm, and most preferably less than about 20 ppm. The fuel's cetane number ranges from about 45 to about 65, preferably from about 45 to about 60, and most preferably from about 50 to about 55. Within those ranges, the cetane value varies in accordance with the Formula. $T_{95}$, a conventionally determined distillation characteristic of the fuel, ranges from about 260° C. to about 370° C., preferably from about 260° C. to about 340° C., and most preferably from about 260° C. to about 320° C. Within those ranges, T95 varies in accordance with the Formula.

The fuel is advantageous when compared to conventional diesel fuels throughout the entire drive cycle, for both light duty and heavy duty diesel engines. The fuel is particularly advantageous during drive cycle periods known as problematic for PM emissions. For example, use of fuel of this invention extends the smoke limited torque operation of the diesel engine, both for light and heavy duty diesel engines, when compared to conventional fuels. The term high torque, synonymously used with high load, means engine torque or engine load greater than about (60%) sixty percent of the engine's maximum load or torque. High RPM and rapid acceleration engine operation conventionally produces higher PM emissions because there is reduced time for optimal air/fuel mixing. The fuel of this invention permits higher RPM/low PM emissions operation for both light and heavy duty diesel engines. The term high RPM is generally defined as RPMs exceeding about 70% of the RPM limit of the particular engine. Rapid acceleration generally means acceleration rates exceeding about 140 RPM at high RPM/sec, and exceeding about 500 RPM/sec at low RPM. Furthermore, the fuel can be further advantageously used under cold start conditions since it produces reduced white smoke emissions, due to the reduced molecular weight of its unburned gas emissions.

In one embodiment, the fuel is used advantageously during periods in which the catalyst in an aftertreatment system undergoes reductive regeneration. In particular, the low PM emissions from this fuel enable higher than conventional use of exhaust gas recirculation (EGR), either external or internal, under cold start conditions and low-load conditions just after cold starting, where the exhaust gas temperature measured at the inlet of the aftertreatment system is below about 250° C., and preferably below about 200° C. Under these conditions, the fuel enables the injection timing to be retarded sufficiently to allow catalyst activation with lower PM production than allowed with conventional fuels. Thus, this fuel is advantageous in forming less deposits in the external EGR circuit, i.e., the EGR cooler and/or EGR valve.

In another embodiment, the fuel is used advantageously with the combustion approach called "smokeless combustion" (see for example U.S. Pat. No. 5,937,639). In smokeless combustion, the catalyst bed temperatures can be maintained over the activation temperature of the catalyst during low load conditions due to the relatively richer combustion caused by higher EGR rate and highly reactive HC emissions. By richer combustion, we mean combustion occurring at elevated equivalence ratio, wherein equivalence ratio is defined as the actual molar ratio of fuel to oxygen divided by the stoichiometric molar ratio of fuel to oxygen. In one embodiment, the fuel of the present invention is supplied at least when EGR level is greater than about 45% at an equivalence ratio greater than about 0.75. EGR level means the percent of exhaust gas relative to total gas (i.e. fresh air and exhaust gas) in the combustion chamber at ignition. In a preferred embodiment, the fuel is supplied when the equivalence ratio is greater than about 0.85, and most preferred when the equivalence ratio exceeds about 0.95. Conversely, operation of the vehicle with conventional diesel combustion approaches results in cooler exhaust gas and catalyst bed temperatures that are below the activation temperature of the catalyst. In the above-mentioned smokeless combustion the catalyst may be deactivated during lower load operation due to coverage of the catalyst surface by Soluble Organic Fraction or "SOF". The fuel of this invention is advantageous in preventing this catalyst deactivation and expanding the lower load limit of smokeless combustion due to its lower SOF formation tendency. Thereby, the fuel is beneficial to an aftertreatment system comprising an oxidation catalyst, $NO_x$ Storage and Reduction or "NSR," Diesel Particulate $NO_x$ Reduction or "DPNR," Diesel Particulate Filter or "DPF," Continuously Regenerable Trap or "CRT" and the like.

In addition, smokeless combustion can be achieved under leaner operating conditions with the fuel of this invention as compared with conventional fuels, resulting in better fuel economy. Also, the fuel is advantageous in expanding the upper load limit of smokeless combustion due to the lower soot formation tendency, resulting in a greater part of the drive cycle where efficient catalyst regeneration is possible.

NSR employs catalysts that store nitrogen oxides ($NO_x$) during engine lean operating conditions. These catalysts require periodic regeneration under fuel rich conditions in order to convert the nitrogen atoms stored as nitrates into molecular nitrogen gas. Conventionally the fuel rich regeneration of the nitrogen trap catalyst results in a tendency to form carbonaceous material or soot, resulting in particulate emissions and catalyst fouling. The low PM fuels of the present invention are of particular advantage in engine operation during such "regenerative" periods of the drive cycle.

DPF, with or without soot oxidation additives, and with or without post injection, requires periodic regeneration to oxidize the accumulated PM on the filter. In the regeneration process, the bed temperature of the DPF catalyst need be maintained within a desirable range, which is sufficiently high to activate PM oxidation yet below temperatures where the DPF undergoes thermal deterioration such as crack generation, melting, and so on. Oftentimes DPF deterioration occurs at "hot spots", which are localized regions where the bed temperature exceeds the deterioration temperature due to deposition of exhaust hydrocarbons and SOF accumulation. The low PM fuels of the present invention generate lower molecular weight hydrocarbon components and reduced SOF, and are thus particularly advantageous in avoiding the generation of "hot spots" on the catalyst surface.

NSR catalysts are poisoned by sulfur through the generation of inorganic sulfates in the catalyst. The catalyst must be periodically regenerated under fuel rich conditions to convert the sulfur atoms stored as sulfates on the catalyst to gaseous sulfur species which are swept away by the exhaust gases. In the regeneration process, the bed temperature of the NSR catalyst need be maintained within a desirable range, which is sufficiently high to activate sulfur regeneration yet below temperatures where the NSR undergoes thermal deterioration such as sintering of the noble metal atoms. Oftentimes NSR deterioration occurs at "hot spots", which are localized regions where the bed temperature exceeds the deterioration temperature due to deposition of exhaust hydrocarbons and SOF accumulation. The low PM fuels in the present invention generate lower molecular weight hydrocarbon components and reduced SOF, and are thus particularly advantageous in avoiding the generation of "hot spots" on the catalyst surface.

The following examples are illustrative of some of the embodiments of the present invention.

EXAMPLE 1

Five fuels were selected for engine testing of their PM emissions under controlled conditions. The molecular composition of the test fuels is shown in Table 2 below.

TABLE 2

Molecular Composition of Test Fuels

| | TF-A | TF-B | TF-C | TF-D | TF-E |
|---|---|---|---|---|---|
| % normal paraffins | 37.1 | 36.6 | 34.6 | 38.7 | 75 |
| % iso-paraffins | 3.8 | 0.8 | 24.5 | 54.7 | 21 |
| % 1-ring cyclo- | 9.1 | 9.6 | 29.1 | 4.8 | 3 |
| % 2-ring cyclo-paraffins | 9.3 | 28.1 | 11.6 | 1.3 | 0.8 |
| % naphtho-aromatics | 5.5 | 2.2 | 0 | 0 | 0 |
| % 1-ring aromatics | 17 | 20.8 | 0.2 | 0.4 | 0.2 |
| % 2-ring aromatics | 18.1 | 2 | 0 | 0 | 0 |
| Sum | 100 | 100 | 100 | 100 | 100 |
| NR | 14.2 | 27.8 | 22.4 | 3.2 | 2.0 |
| AR | 25.2 | 11.6 | 0.1 | 0.2 | 0.1 |
| Cetane No. | 48.9 | 53.3 | 55.9 | 52.5 | 80.5 |

TABLE 2-continued

| Molecular Composition of Test Fuels | | | | | |
|---|---|---|---|---|---|
| | TF-A | TF-B | TF-C | TF-D | TF-E |
| T95 (° C.) | 314.5 | 321 | 304 | 324 | 326.5 |
| SulfurContent | 38 ppm | 45 ppm | ~1 ppm | 120 ppm | 120 ppm |

Of the five fuels, one fuel was representative of a conventional diesel fuel, (designated TF-A). A Fisher-Tropsch analog (designated TF-E) was chosen to represent a synthetic diesel fuel known in the art to have substantially reduced PM emissions when operated in a diesel engine.

In accordance with the Formula, the PEI values for the Test Fuels are shown in Table 3 below. TF-A and TF-B have a PEI value significantly greater than 100; TF-C and TF-E have PEI values slightly above 100; TF-D has a PEI value significantly less than 100; all the foregoing in accordance with the Formula of the present invention.

| PEI VALUES | | | | | |
|---|---|---|---|---|---|
| | TF-A | TF-B | TF-C | TF-D | TF-E |
| PEI | 156 | 140 | 101 | 83 | 106 |

The fuels were tested using a light duty, single cylinder compression ignition engine with common rail direct injection. Exhaust emissions were analyzed using an exhaust gas analyzer, a Bosch-type smoke meter and a full-dilution tunnel. Tests were conducted for four combinations of speed and load; exhaust emissions were analyzed for particulate matter. As shown in FIG. 1, fuels having a PEI index less than TF-A have reduced PM emissions. TF-D, having a PEI index of about 83 demonstrated a lower average value of PM emissions over these combinations of speed and load than all other fuels including TF-E, the Fischer Tropsch analogue fuel.

The Formula may be used to either identify fuels that will produce low PM emissions, or as a means of reducing PM emissions of a formulated fuel. The latter is accomplished by identifying the PEI value for a given fuel, then modifying the fuel's molecular composition in accordance with the Formula to reduce its PEI.

EXAMPLE 2

Figure 2:
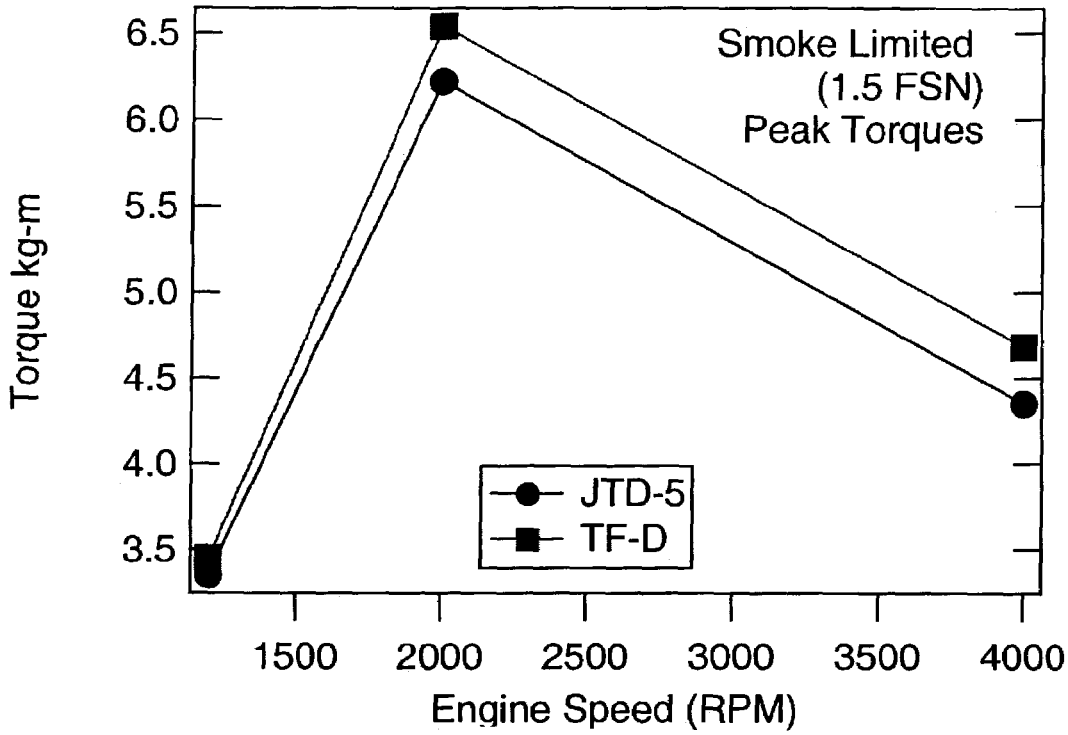
FIG. 2 is a graph showing performance results from tests of a fuel of this invention relative to a conventional fuel.

Fuel TF-D was evaluated in a high-speed direct injection (HSDI) engine in comparison to a conventional diesel fuel, JTD-5. As shown in FIG. 2, smoke-limited, full-load torques of TF-D are about 8% higher at medium and high speeds compared with those of JTD-5, a conventional diesel fuel. This advantage of TF-D was derived from the lower PM production of this fuel relative to conventional fuels at high-load conditions.

EXAMPLE 3

Figure 3:
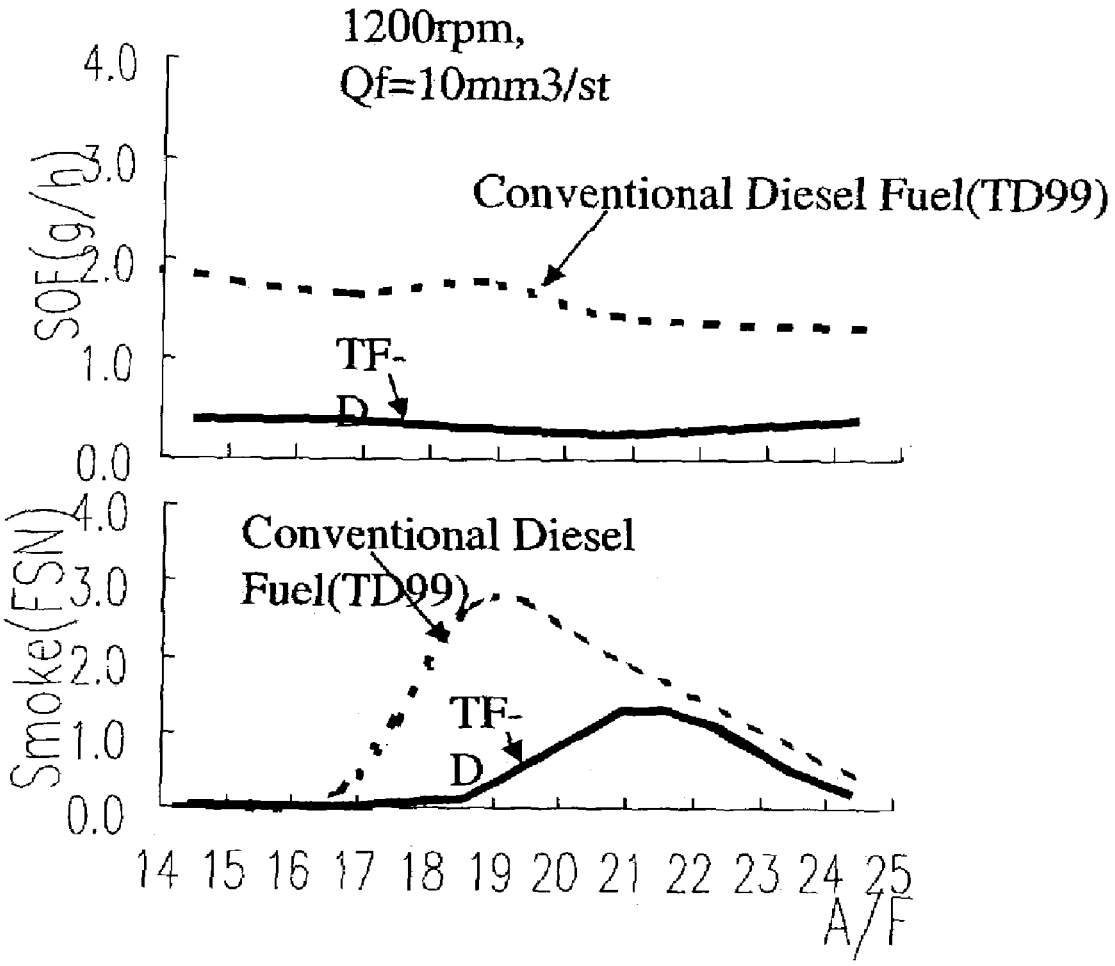
FIG. 3 is a graph showing smoke and soluble organic fraction (SOF) emissions from tests of fuels of this invention relative to a conventional fuel.

Fuel TF-D was evaluated in the mode of "smokeless combustion" in a multi-cylinder HSDI engine in comparison to a conventional diesel fuel designated TD-99. As shown in FIG. 3, TF-D produces lower smoke and SOF emissions than conventional diesel fuel across a wide range of air/fuel ratios.

FIG. 3 also shows that TF-D permits smokeless combustion under leaner conditions compared with conventional fuels. This means that smokeless combustion can be achieved with resulting better fuel economy with TF-D than with conventional fuels.

What is claimed is:

1. A fuel for a compression ignition engine having a particulate emission index PEI of less than about 100, said fuel being characterized as:

a) having a cetane number ranging from about 45 to about 65, and a T95 that ranges from about 304° to 370° C.

b) having a value of NR and AR, cetane number and T95 in ° C. according to the Formula:

$$PEI \leqq 100 = 156 + Z1 \times (\text{Cetane\#} - 49) + Z2 \times (NR - 14) + Z3 \times (AR - 25) + Z4 \times (T95 - 315^\circ\ \text{C.})$$

Where:

Z1 is about 0.87,

Z2 is about 1.09,

Z3 is about 2.67,

Z4 is about 0.2.

2. The fuel of claim 1 wherein said cetane number ranges from about 45 to about 60.

3. The fuel of claim 2 wherein said cetane number range from about 50 to about 55.

4. The fuel of claim 1, said fuel being further characterized as having a sulfur content less than about 120 wppm.

5. The fuel of claim 4 wherein said sulfur content is less than about 30 wppm.

6. The fuel of claim 5 wherein said sulfur content is less than about 10 wppm.

7. A method of blending a diesel fuel that exhibits reduced particulate emissions in an operating compression ignition engine, said method comprising:

Selecting at least first and second fuel blending components,

Identifying an AR value and an NR value, cetane number, and T95 in ° C. for at least the first and second fuel components, Blending at least said first and second fuel components to provide a fuel having a PEI less than about 100 according to the Formula:

$$PEI \leqq 100 = 156 + Z1 \times (\text{Cetane\#} - 49) + Z2 \times (NR - 14) + Z3 \times (AR - 25) + Z4 \times (T95 - 315^\circ\ \text{C.});$$

and having a cetane number ranging from about 45 to about 65, and a T95 less than about 304° C. to 370° C.

Where:

Z1 is about 0.87,

Z2 is about 1.09,

Z3 is about 2.67,

Z4 is about 2.0.

8. The fuel of claim 7 wherein said cetane number ranges from about 45 to about 60.

9. The fuel of claim 8 wherein said cetane number range from about 50 to about 55.

10. The method of claim 7, said fuel by further characterized as having a sulfur content less than about 120 wppm.

11. The method of claim 10 wherein said sulfur content is less than about 30 wppm.

12. The method of claim 11 wherein said sulfur content is less than about 10 wppm.

13. A method of reducing particulate emissions from fuels operating in a compression ignition engine, said method comprising:

Identifying an AR value and an NR value, cetane number, and T95 in ° C. for the fuel, Determining a PEI for the fuel using the Formula PEI=156+Z1×(Cetane#−49)+Z2×(NR−14)+Z3×(AR−25)+Z4×(T95 −315° C.), Changing the fuel to alter the value of NR, the value of AR, cetane number, the T95 distillation characteristics in ° C., or a combination thereof for the fuel in accordance with the Formula and having a cetane number ranging from about 45 to about 65, and a T95 less than about 304° C. to 370° C. whereby the PEI for the changed fuel is less than about 95% of the PEI for the original fuel and less than about 100, Where:

Z1 is about 0.87,

Z2 is about 1.09,

Z3 is about 2.67,

Z4 is about 2.0, operating said engine using the changed fuel.

14. The method of claim 13 wherein said cetane number ranges from about 45 to about 60.

15. The method of claim 14 wherein said cetane number range from about 50 to about 55.

16. The method of claim 13, said fuel by further characterized as having a sulfur content less than about 120 wppm.

17. The method of claim 16 wherein said sulfur content is less than about 30 wppm.

18. The method of claim 17 wherein said sulfur content is less than about 10 wppm.

19. A method for reducing particulate emissions from an operating compression ignition engine comprising:

Supplying said engine with at least a first and second fuel, said first fuel having a cetane number ranging from about 45 to about 65, and a T95 that ranges from about 304° C. to 370° C., and having a value of AR, a value of NR, cetane number and T95 distillation characteristics in ° C. according to the Formula:

$$PEI \leqq 100 = 156 + Z1 \times (\text{Cetane\#} - 49) + Z2 \times (NR - 14) + Z3 \times (AR - 25) + Z4 \times (T95 - 315°\ \text{C.})$$

Where:

Z1 is about 0.87,

Z2 is about 1.09,

Z3 is about 2.67,

Z4 is about 2.0,

Where said first fuel is supplied to the engine at least during: 1) high EGR level operation, 2) catalyst regeneration operation, 3) high engine torque driving cycle periods, 4) high-altitude operation, 5) rapid acceleration operation, 6) cold start conditions, or a combination thereof.

20. The method of claim 19 wherein said first fuel is supplied to the engine at least when engine torque is greater than or equal to about sixty (60%) percent of maximum engine torque.

21. The method of claim 20 wherein said first fuel is supplied to the engine at least when engine torque is greater than or equal to about eighty (80%) percent of maximum engine torque.

22. The method of claim 19 wherein said first fuel is supplied to the engine at least when exhaust gas recycle level is greater than or equal to about forty five percent and equivalence ratio is greater than 0.75.

23. The method of claim 22 wherein said first fuel is supplied to the engine at least when the equivalence ratio is over 0.85.

24. The method of claim 23 wherein said first fuel is supplied to the engine at least when the equivalence ratio is greater than 0.95.

25. The method of claim 19 wherein said first fuel is supplied to the engine at least when engine is operated at an altitude of over 800 m.

26. The method of claim 25 wherein said first fuel is supplied to the engine at least when engine is operated at an altitude of over 1500 m.

27. The method of claim 19 wherein said first fuel is supplied to the engine at least when the engine is accelerated at acceleration rates of over 70 RPM/sec at high vehicle speed and of over 250 RPM/sec at low vehicle speed.

28. The method of claim 27 wherein said first fuel is supplied to the engine at least when the engine is accelerated at the acceleration rates of over 140 RPM/sec at high vehicle speed and of over 500 RPM/sec at low vehicle speed.

29. The method of claim 19 wherein said cetane number ranges from about 45 to about 60.

30. The method of claim 29 wherein said cetane number range from about 50 to about 55.

31. The method of claim 19 wherein T95 is about 304° C.

32. The method of claim 19, said fuel by further characterized as having a sulfur content less than about 120 wppm.

33. The method of claim 32 wherein said sulfur content is less than about 30 wppm.

34. The method of claim 33 wherein said sulfur content is less than about 10 wppm.

35. A method for reducing particulate emissions from an operating compression ignition engine comprising:

Supplying said engine with at least a first and second fuel, said first fuel having a cetane number ranging from about 45 to about 65, and a T95 that ranges from about 304° C. to 370° C., and having a NR value, an AR value, cetane number and T95 distillation characteristics in ° C. according to the Formula:

$$PEI \leqq 100 = 156 + Z1 \times (\text{Cetane\#} - 49) + Z2 \times (NR - 14) + Z3 \times (AR - 25) + Z4 \times (T95 - 315°\ \text{C.})$$

Where:

Z1 is about 0.87,

Z2 is about 1.09,

Z3 is about 2.67,

Z4 is about 2.0,

Where said engine is used in conjunction with an aftertreatment system comprising Selective Catalytic Reduction, $NO_x$ Storage and Reduction, Diesel Particulate Filter, Continuously Regenerating Trap, Diesel Particulate-$NO_x$ Reduction, or a combination thereof.

36. The method of claim 35 in which said first fuel is supplied to the engine and/or the aftertreatment system at least when exhaust gas temperature measured at an inlet of the aftertreatment system is below 250° C.

37. The method of claim 36 in which said first fuel is supplied to the engine and/or the aftertreatment system at least when the exhaust gas temperature measured at the inlet of the aftertreatment system is below 200° C.

38. The method of claim 35 in which said first fuel is supplied to the engine and/or the aftertreatment system at least during fuel rich regeneration for NSR and/or DPNR in order to convert nitrogen atoms stored as nitrates into molecular nitrogen gas.

39. The method of claim 35 in which said first fuel is supplied to the engine and/or the aftertreatment system at least during fuel rich regeneration for NSR and/or DPNR to convert sulfur atoms stored as sulfates on the catalyst into gaseous sulfur species.

40. The method of claim 35 in which said first fuel is supplied to the engine and/or the aftertreatment system at least during regeneration of the DPF in order to oxidize accumulated particulate matter.

41. The method of claim 35 in which said first fuel is supplied to the engine and/or the aftertreatment system at least when engine is operated in a region of smokeless combustion.

42. The method of claim 35 wherein the aftertreatment system is a DPF system with or without soot oxidation additives.

43. The method of claim 35 wherein the aftertreatment system is a Selective Catalytic Reduction system with or without urea.

44. The method of claims 35, 36, 38, 40, 41, or 43, wherein said engine is a light duty diesel engine.

* * * * *